US010252174B2

(12) United States Patent
Morita et al.

(10) Patent No.: US 10,252,174 B2
(45) Date of Patent: Apr. 9, 2019

(54) BALLOON

(71) Applicant: TAKARA KOSAN CO., LTD., Ota-ku, Tokyo (JP)

(72) Inventors: Takemi Morita, Tokyo (JP); Mitsunori Yoshida, Tokyo (JP); Akira Nakamura, Tokyo (JP); Satoru Taniguchi, Tokyo (JP); Takuya Ogura, Tokyo (JP)

(73) Assignee: Takara Kosan Co., Ltd. (JP)

( * ) Notice: Subject to any disclaimer, the term of this patent is extended or adjusted under 35 U.S.C. 154(b) by 0 days.

(21) Appl. No.: 15/744,610

(22) PCT Filed: Sep. 7, 2016

(86) PCT No.: PCT/JP2016/076279
§ 371 (c)(1),
(2) Date: Jan. 12, 2018

(87) PCT Pub. No.: WO2017/043519
PCT Pub. Date: Mar. 16, 2017

(65) Prior Publication Data

US 2018/0236366 A1 Aug. 23, 2018

(30) Foreign Application Priority Data

Sep. 11, 2015 (JP) ..... 2015-179806

(51) Int. Cl.
*A63H 27/10* (2006.01)

(52) U.S. Cl.
CPC ..... *A63H 27/10* (2013.01); *A63H 2027/1025* (2013.01); *A63H 2027/1033* (2013.01);
(Continued)

(58) Field of Classification Search
CPC ..... A63H 27/10; A63H 2027/1025; A63H 2027/1041; A63H 2027/1075; A63H 2027/1083
(Continued)

(56) References Cited

U.S. PATENT DOCUMENTS 2,540,403 A * 2/1951 Myers ..... A63H 27/10 446/221
2,635,387 A * 4/1953 Anderson ..... A63H 27/10 446/221
(Continued)

FOREIGN PATENT DOCUMENTS

JP S61-085292 U 6/1986
JP H07-505544 A 6/1995
(Continued)

*Primary Examiner* — Alexander R Niconovich
(74) *Attorney, Agent, or Firm* — Harness, Dickey & Pierce, P.L.C.

(57) ABSTRACT

A balloon includes two joined plastic films. The balloon includes: a gas supply valve sandwiched between and joined to the first film and the second film; a first chamber receiving air supplied from the gas supply valve for expansion; and a second chamber communicating to the first chamber. The gas supply valve includes a gas passage that extends from a gas inlet positioned on an outer side of the second chamber to an inside of the first chamber through the second chamber. Part of the first film and the second film between the first chamber and the second chamber and between the gas passage and a peripheral edge of the balloon are joined together to form a first weld portion and a second weld portion. The first weld portion is formed on an opposite side of the second weld portion with the gas passage sandwiched therebetween.

12 Claims, 8 Drawing Sheets

(52) U.S. Cl.
CPC ..... *A63H 2027/1041* (2013.01); *A63H 2027/1083* (2013.01)

(58) Field of Classification Search
USPC ..... 446/220, 221, 224
See application file for complete search history.

(56) References Cited

U.S. PATENT DOCUMENTS 4,674,532 A * 6/1987 Koyanagi ..... A63H 27/10 137/512.15
4,681,138 A * 7/1987 Giuliani ..... A63H 27/10 137/516.29
4,708,167 A * 11/1987 Koyanagi ..... F16K 15/147 137/512.15
5,108,339 A * 4/1992 Kieves ..... A63H 27/10 446/220
5,188,558 A * 2/1993 Barton ..... A63H 27/10 446/220
5,248,275 A * 9/1993 McGrath ..... A63H 27/10 137/512.15
5,306,194 A * 4/1994 Epstein ..... A63H 27/10 446/220
5,334,072 A * 8/1994 Epstein ..... A63H 27/10 446/220
5,451,179 A * 9/1995 LaRoi, Jr. ..... A63H 27/10 383/3
5,460,200 A * 10/1995 Glicksman ..... F16K 15/147 137/512.4
5,482,492 A * 1/1996 Becker ..... A63H 27/10 383/44
5,713,777 A * 2/1998 Greenwald ..... A63H 3/06 446/223
5,860,441 A * 1/1999 Garcia ..... A63H 27/10 137/15.18
5,934,310 A * 8/1999 Littlehorn ..... A63H 27/10 137/223
6,027,394 A * 2/2000 Tarazaga Carrasco ..... A63H 27/10 446/220
6,176,758 B1 * 1/2001 Wu ..... A63H 3/06 446/220
6,192,917 B1 * 2/2001 Ramos Loza ..... A63H 27/10 137/223
6,435,935 B1 * 8/2002 Komaba ..... A63H 27/10 446/220
6,575,805 B1 * 6/2003 Ansolabehere ..... A63H 27/10 40/214
6,699,095 B1 * 3/2004 Epstein ..... A63H 3/06 446/222
6,758,715 B2 * 7/2004 Banks ..... A63H 3/06 446/186
7,335,083 B2 * 2/2008 Hwang ..... A63H 27/10 446/220
7,708,616 B2 * 5/2010 Phillips ..... A63H 27/10 446/220
8,512,091 B2 * 8/2013 Nelson ..... A63H 27/10 446/220
9,474,984 B1 * 10/2016 Yabe ..... A63H 27/10

FOREIGN PATENT DOCUMENTS

JP H07-033837 Y2 8/1995
JP H09-285648 A 11/1997
JP 2008-095886 A 4/2008

* cited by examiner

BALLOON

TECHNICAL FIELD

The present invention relates to a balloon to be fixed to a stick.

BACKGROUND ART

Hitherto, there has been known an anchoring tool for fixing a rubber balloon, a plastic balloon, or the like to a distal end of a stick (for example, JP 61-85292 and JP 7-33837). As such anchoring tool, a cup 7 and a stick 8 have been distributed on the market as accessories separately from a balloon 100, for example, as illustrated in FIG. 7.

The cup 7 includes a funnel-shaped portion and a tubular body formed integrally with a bottom part of the funnel-shaped portion. The funnel-shaped portion receives and fixes an opening part of the balloon 100 thereto and steadily support a lower end of the balloon 100. A tubular or solid bar-shaped stick 8 is inserted and fixed to the tubular body.

The balloon assembled as described above is formed into a state as illustrated in FIG. 6. The opening part of the balloon 100 is inserted into the funnel-shaped portion of the cup 7, and the lower end of the balloon 100 is firmly supported by an outer periphery of the funnel-shaped portion. The stick 8 is inserted and connected to the tubular body of the cup 7. In the assembled state as described above, the balloon 100 is firmly supported by the stick 8 without wobbling with respect to the stick 8 or swinging with the wind.

When advertisement or the like is printed on a surface of the balloon 100 described above, the advertisement surface can be displayed in an intended direction in front of a store or the like, and the sales promotion effect can be enhanced in combination with gorgeousness and amusing atmosphere of the balloon.

However, when the cup 7 described above is used, there is the following problem. An operation of fixing the balloon 100 to the cup 7 is required after air is blown into the balloon 100. In particular, when a large number of the balloons 100 are exhibited at a festive event, the operation becomes cumbersome.

Further, there has been known a film balloon that is formed by overlapping two films on one another, welding an outer peripheral part excluding an air injection portion, and inserting a check valve into the air injection portion, followed by welding, so as to ensure an air passage (for example, JP 9-285648). With this balloon, a long mounting leg portion arranged in the opening part of the balloon is wound and bound around a retaining bar having a ring-shaped winding portion instead of the cup at a distal end, thereby being fixed to the retaining bar. Even with such balloon, an operation procedure for winding and binding the mounting leg portion is required.

An objective of the invention is to provide a balloon capable of stably keeping a posture in a state fixed to a stick.

SUMMARY

The invention has been made to solve at least a part of the above-mentioned problems, and can be achieved as the following embodiment or application examples.

Application Example 1

According to one embodiment of the invention, there is provided a balloon (1) including two joined plastic films (10, 12), the balloon (1) including:

a first film (10);

a second film (12) joined to the first film (10);

a gas supply valve (6) sandwiched between and joined to the first film (10) and the second film (12);

a first chamber (14) receiving air supplied from the gas supply valve (6) for expansion; and a second chamber (16) communicating to the first chamber (14), wherein the gas supply valve (6) includes a gas passage (61) that extends from a gas inlet (62) positioned on an outer side of the second chamber (16) to an inside of the first chamber (14) through the second chamber (16), wherein part of the first film (10) and the second film (12) between the first chamber (14) and the second chamber (16) and between the gas passage (61) and a peripheral edge (5) of the balloon (1) are joined together to form a first weld portion (22) and a second weld portion (24), and in which the first weld portion (22) is formed on an opposite side of the second weld portion (24) with the gas passage (61) sandwiched therebetween.

Application Example 2

In the balloon, the gas passage (61) may be capable of receiving a stick (8) to the inside of the first chamber (14) within a range free from damaging a function of a check valve in the first chamber (14).

Application Example 3

In the balloon, the second chamber (16) may have a shape that gradually spreads from the side of the gas inlet (62) to the side of the first chamber (14).

Application Example 4

In the balloon, the second chamber (16) may have a substantially triangular shape in front view.

Application Example 5

In the balloon, the first film (10) and the second film (12) may be joined together through thermal welding at the peripheral edge (5).

Application Example 6

In the balloon, the gas supply valve (6) of the balloon (1) may have a tubular stick (8) inserted thereinto.

Application Example 7

In the balloon, the tubular stick (8) may extend to the inside of the first chamber (14).

Advantageous Effects of Invention

The balloon according to the invention can stably keep the posture in the state fixed to the stick.

DETAILED DESCRIPTION

Now, detailed description is made of an embodiment of the invention with reference to the drawings. The embodiment described below does not unduly limit the scope of the present invention as stated in the claims. Further, all of the elements described below should not necessarily be taken as essential elements of the invention.

1. Configuration of Balloon

Figure 1:
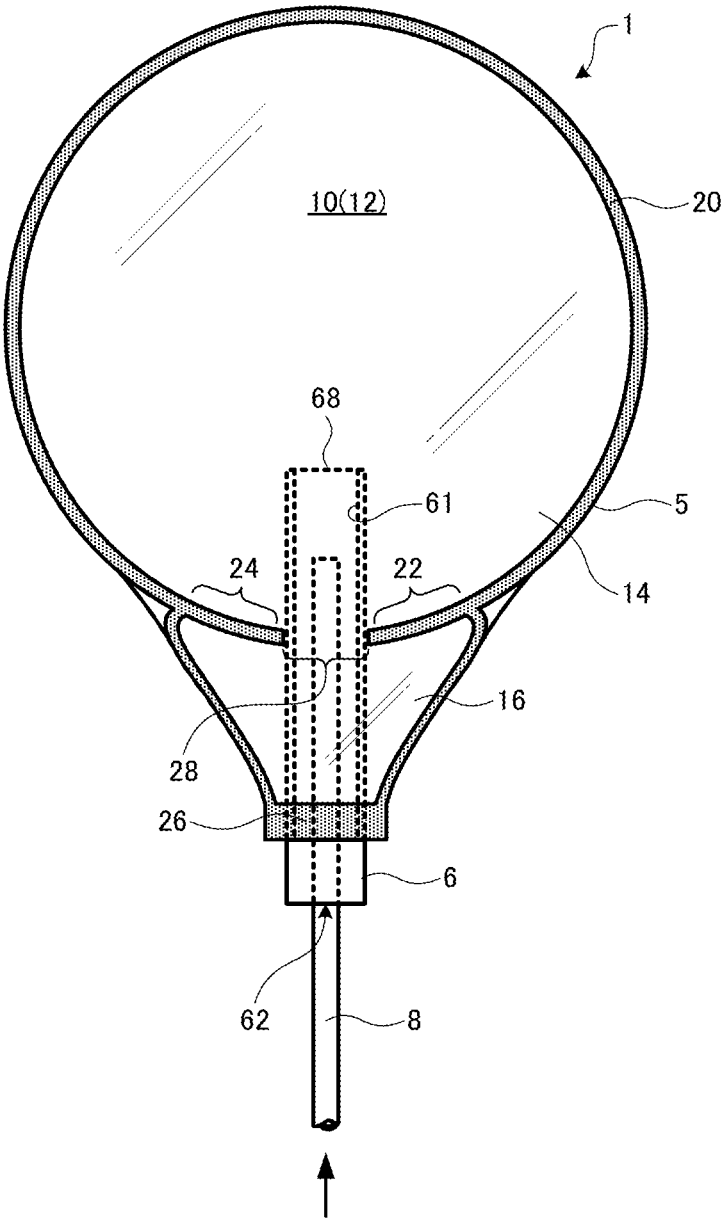
FIG. 1 is a front view of a balloon according to an embodiment of the invention.
Figure 2:
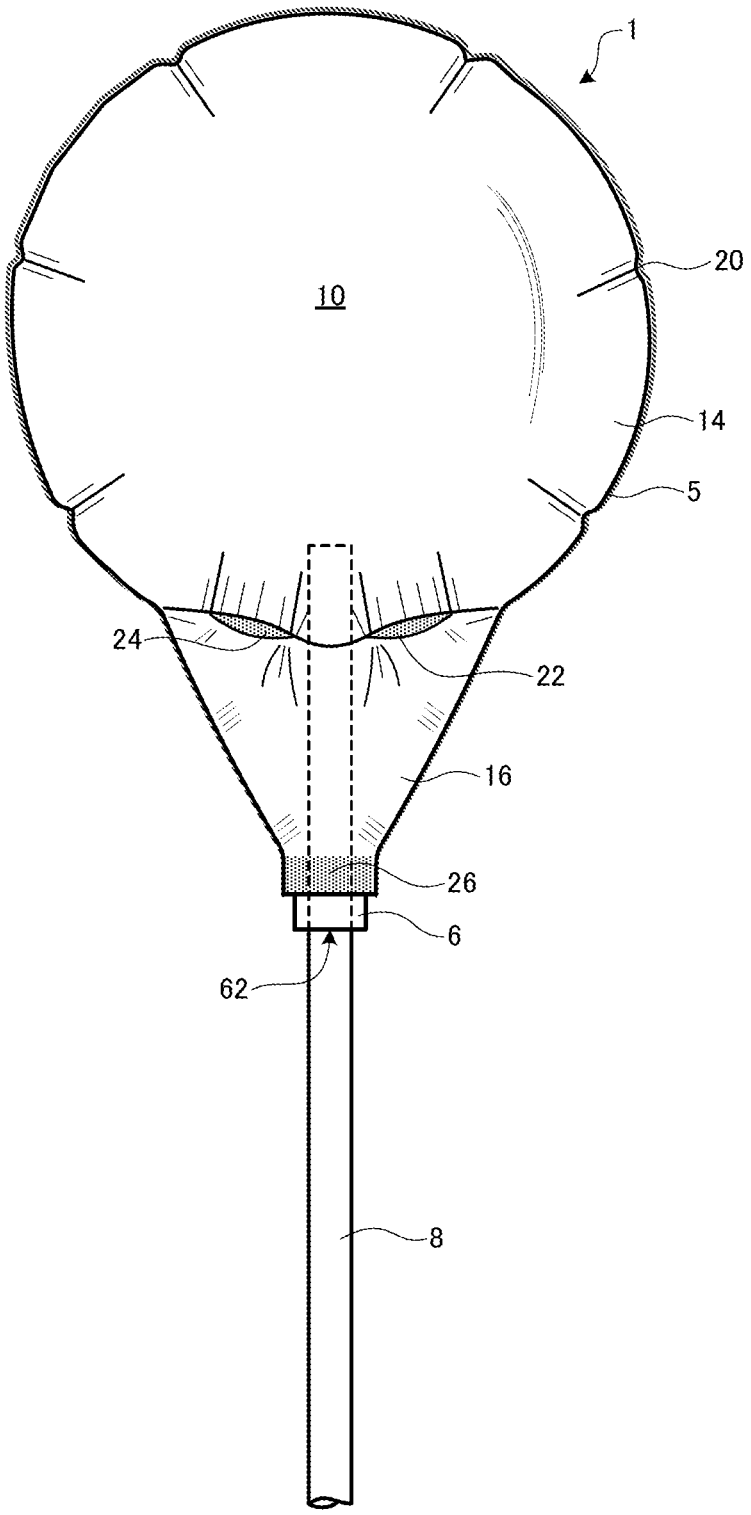
FIG. 2 is a front view of the balloon according to the embodiment in an expanded state.
Figure 3:
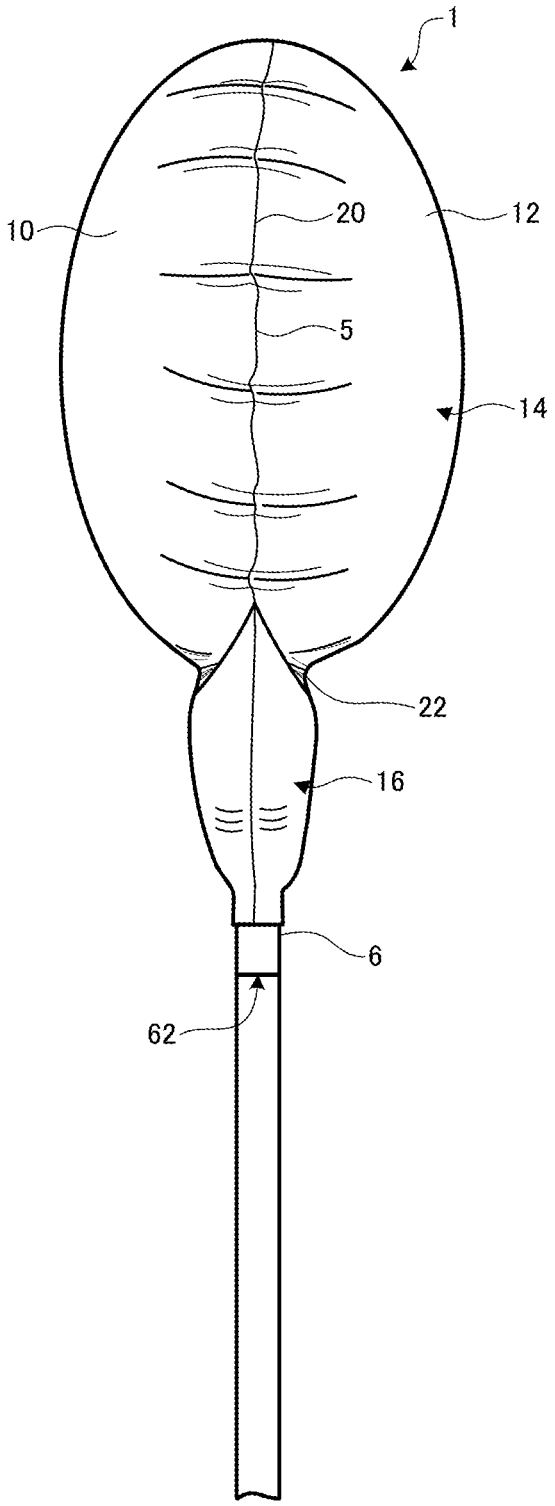
FIG. 3 is a side view of the balloon according to the embodiment in the expanded state.
Figure 4:
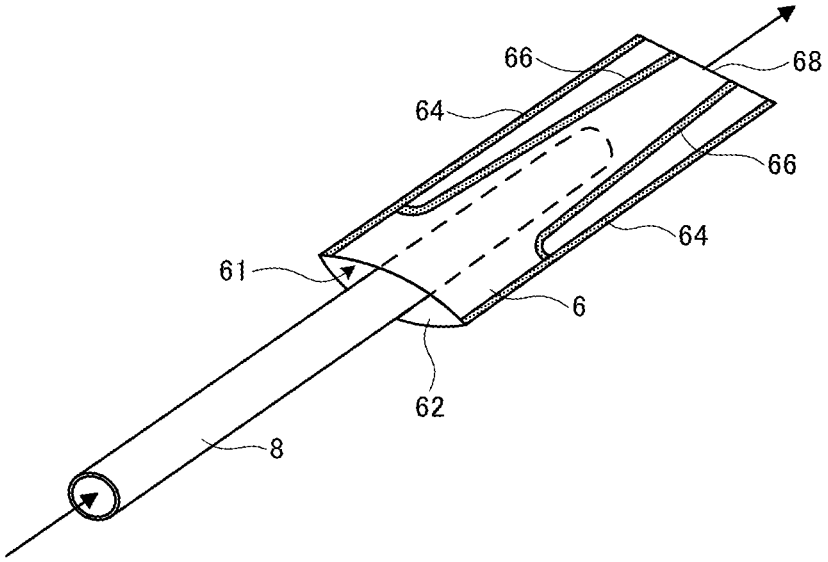
FIG. 4 is a perspective view for illustrating a gas supply valve.
Figure 5:
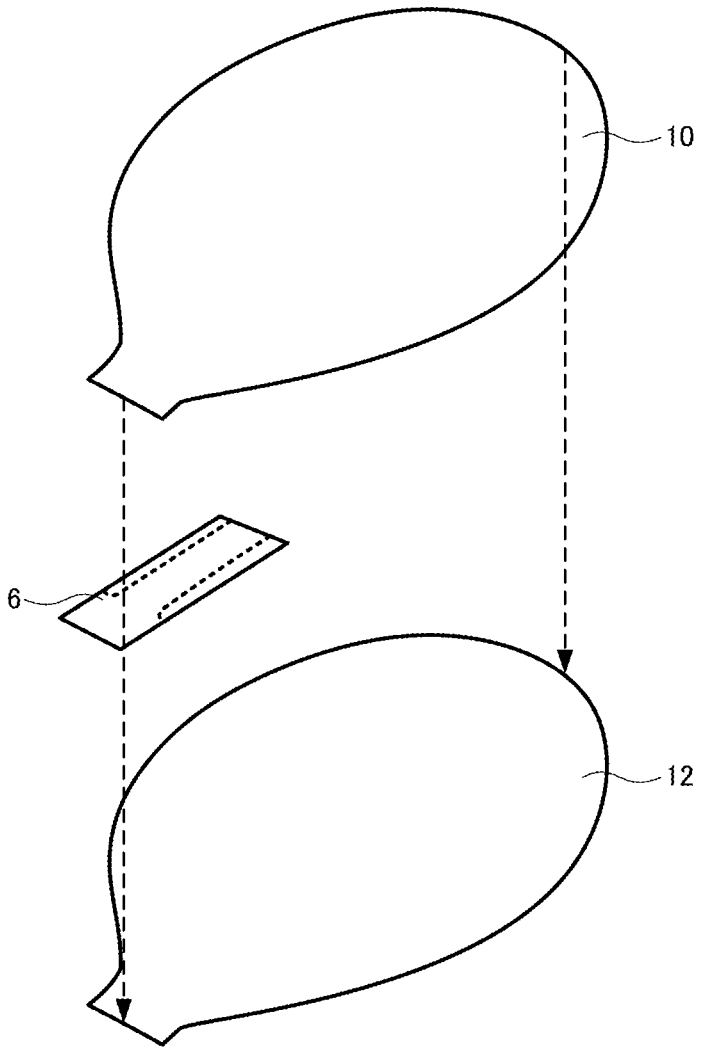
FIG. 5 is a perspective view for illustrating a manufacturing process of the balloon according to the embodiment.

First, a configuration of a balloon 1 according to an embodiment of the invention is described with reference to FIG. 1 to FIG. 5. FIG. 1 is a front view of the balloon 1. FIG. 2 is a front view of the balloon according to the embodiment in an expanded state. FIG. 3 is a side view of the balloon according to the embodiment in the expanded state. FIG. 4 is a perspective view for illustrating a gas supply valve. FIG. 5 is a perspective view for illustrating a manufacturing process of the balloon according to the embodiment.

As illustrated in FIG. 1, the balloon 1 is formed by joining two plastic films 10 and 12 together. The second film 12 is positioned on a back surface of the first film 10. In FIG. 1, gas is not blown to expand the balloon 1, and the back surface is in a similar state.

The balloon 1 includes the first film 10, the second film 12 joined to the first film 10 (see FIG. 3 and FIG. 5), a gas supply valve 6 sandwiched between and joined to the first film 10 and the second film 12, a first chamber 14 receiving air supplied from the gas supply valve 6 for expansion, and a second chamber 16 communicating to the first chamber 14. The first film 10 and the second film 12 have the same shape.

A peripheral edge 5 of the balloon 1 is formed when the first film 10 and the second film 12 are joined together. The first film 10 and the second film 12 can be joined together through thermal welding described later. In this case, the peripheral edge 5 of the balloon 1 is a portion in which peripheral edges of the first film 10 and the second film 12 having the same shape are overlapped with one another, and has a width of, for example, from about 0.5 mm to about 5 mm. The films are joined together on a substantially entire circumference of the peripheral edge 5. Meanwhile, in a joint portion 26, a front surface of the gas supply valve 6 and the first film 10 are joined together, and a back surface of the gas supply valve 6 and the second film 12 are joined together.

As illustrated in FIG. 1, the gas supply valve 6 includes a gas passage 61 that extends from a gas inlet 62 positioned on an outer side of the second chamber 16 to an inside of the first chamber 14 through the second chamber 16. The gas supply valve 6 includes a gas passage 61 in which two plastic films are overlapped with one another and joined together and which extends in a longitudinal direction at the center of the gas supply valve 6. Both ends of the gas passage 61 are opened. When gas is blown into the balloon 1, the gas passage 61 is expanded to serve as a passage for the gas. When the blowing of the gas is stopped, the two plastic films are brought into close contact with each other with an internal pressure of the first chamber 14 to close the passage of the gas, thereby functioning as a check valve.

In the balloon 1, a first weld portion 22 and a second weld portion 24, in which the first film 10 and the second film 12 are joined together, are formed between the first chamber 14 and the second chamber 16 and between the gas passage 61 and the peripheral edge 5 of the balloon 1. The first weld portion 22 is formed on an opposite side of the second weld portion 24 with the gas passage 61 sandwiched therebetween. The first weld portion 22 and the second weld portion 24 form a part of a circular outer periphery forming the outer shape of the first chamber 14. A ventilation port 28 that causes the first chamber 14 and the second chamber 16 to communicate to each other is formed between the first weld portion 22 and the second weld portion 24.

In the ventilation port 28, the first film 10 and the second film 12 are not joined together, and the gas is allowed to move between the first chamber 14 and the second chamber 16. The width of the ventilation port 28 is equal to or slightly larger than that of the gas supply valve 6.

The gas passage 61 is capable of receiving a stick 8 to the inside of the first chamber 14 within a range free from damaging a function of a check valve in the first chamber 14. That is, the stick 8 is inserted into the gas passage 61 through the gas inlet 62 so that a distal end thereof is inserted into the inside of the first chamber 14 deeper than the ventilation port 28.

The second chamber (16) may have a shape that gradually spreads from the gas inlet (62) side to the first chamber (14) side. The second chamber 16 has, for example, a substantially triangular shape having an apex on the gas inlet 62 side in front view as illustrated in FIG. 1.

In FIG. 1, there is illustrated a state in which the stick 8 is inserted into the gas supply valve 6, but the stick 8 and the balloon 1 may be separately packaged in a distribution stage. Further, the stick 8 is not limited to a pipe body, and may have a solid bar shape. When the stick 8 is a solid bar, it is appropriate that the balloon 1 be expanded in advance with a tool (for example, an air pump) for expanding the balloon 1, and then the stick 8 be inserted into the gas supply valve 6. When the stick 8 is a pipe body, the stick 8 can be used as a tool for supporting the expanded balloon 1 as well as a tool for expanding the balloon 1. It is preferred that the thickness of the stick 8 be smaller than the inner diameter of the gas passage 61 so that the stick 8 can be inserted into the gas supply valve 6. However, it is preferred that the thickness of the stick 8 be slightly smaller than the inner diameter of the gas passage 61 so that the stick 8 is less liable to be pulled out from the gas passage 61 after the balloon 1 is expanded.

Further, when the balloon 1 is distributed by being packaged under a state in which the stick 8 is inserted into the gas supply valve 6 in advance as illustrated in FIG. 1, it is preferred that the stick 8 and the balloon 1 be fixed with fixing means, for example, a pressure-sensitive adhesive tape or an adhesive, under a state in which the stick 8 is inserted into an appropriate position of the gas supply valve 6. The reason for this is to reliably maintain the positional relationship between the stick 8 and the gas supply valve 6 in an appropriate state. With this, for example, the following situation can be prevented. The stick 8 is inserted into the vicinity of a distal end of the gas supply valve 6 in a distribution process or the like to inhibit the valve function of the gas supply valve 6.

1.1. Balloon in Expanded State

Next, the balloon 1 in an expanded state is described with reference to FIG. 2 and FIG. 3.

As illustrated in FIG. 2 and FIG. 3, when gas is blown into the balloon 1 from the gas supply valve 6, the balloon 1 is expanded. The tubular stick 8 is inserted into the gas supply valve 6 of the balloon 1, thereby being capable of blowing the gas from outside with the stick 8. As the gas, known gas to be used in balloons can be adopted. However, the balloon is fixed to the stick 8 as a precondition, and hence air is generally used.

The two films 10 and 12 are joined together at the peripheral edge 5 of the balloon 1. Therefore, when gas is sent into the balloon 1 from the gas supply valve 6, the gas enters the second chamber 16 communicating to the first chamber 14 as well as the first chamber 14, with the result that the balloon 1 is expanded into a predetermined shape. Here, in front view as illustrated in FIG. 2, the first chamber 14 has a substantially circular shape, and the second chamber 16 has a substantially triangular shape. The second chamber 16 has a shape that gradually spreads to the first chamber 14 side. With this, the first chamber 14 is less liable to swing in a horizontal direction of FIG. 2 with respect to the second chamber 16.

The stick 8 is inserted into the gas passage 61 through the gas inlet 62 and extends to the inside of the first chamber 14. There is a predetermined interval between a distal end of the stick 8 and a distal end 68 of the gas supply valve 6 (see FIG. 1), and a portion of the gas supply valve 6 positioned in the predetermined interval functions as a check valve. The films forming the gas passage 61 are brought into close contact with each other with an internal pressure of each chamber with respect to the stick 8 in the first chamber 14 and the second chamber 16, and hence it is difficult to pull out the stick 8 from the gas passage 61. That is, the stick 8 is reliably fixed to the balloon 1.

The stick 8 limits the movement of the balloon 1 in a horizontal direction of FIG. 3 with the joint portion 26 and the ventilation port 28 with which the stick 8 is brought into contact through intermediation of the gas supply valve 6. The first chamber 14 and the second chamber 16 are integrally formed, and the second chamber 16 is expanded, with the result that the second chamber 16 keeps a predetermined position with respect to the first chamber 14. In addition, the stick 8 supports the balloon 1 in at least two portions (joint portion 26 and ventilation port 28). Therefore, in particular, the swing of the balloon 1 in the horizontal direction of FIG. 3 can be limited.

Figure 6:
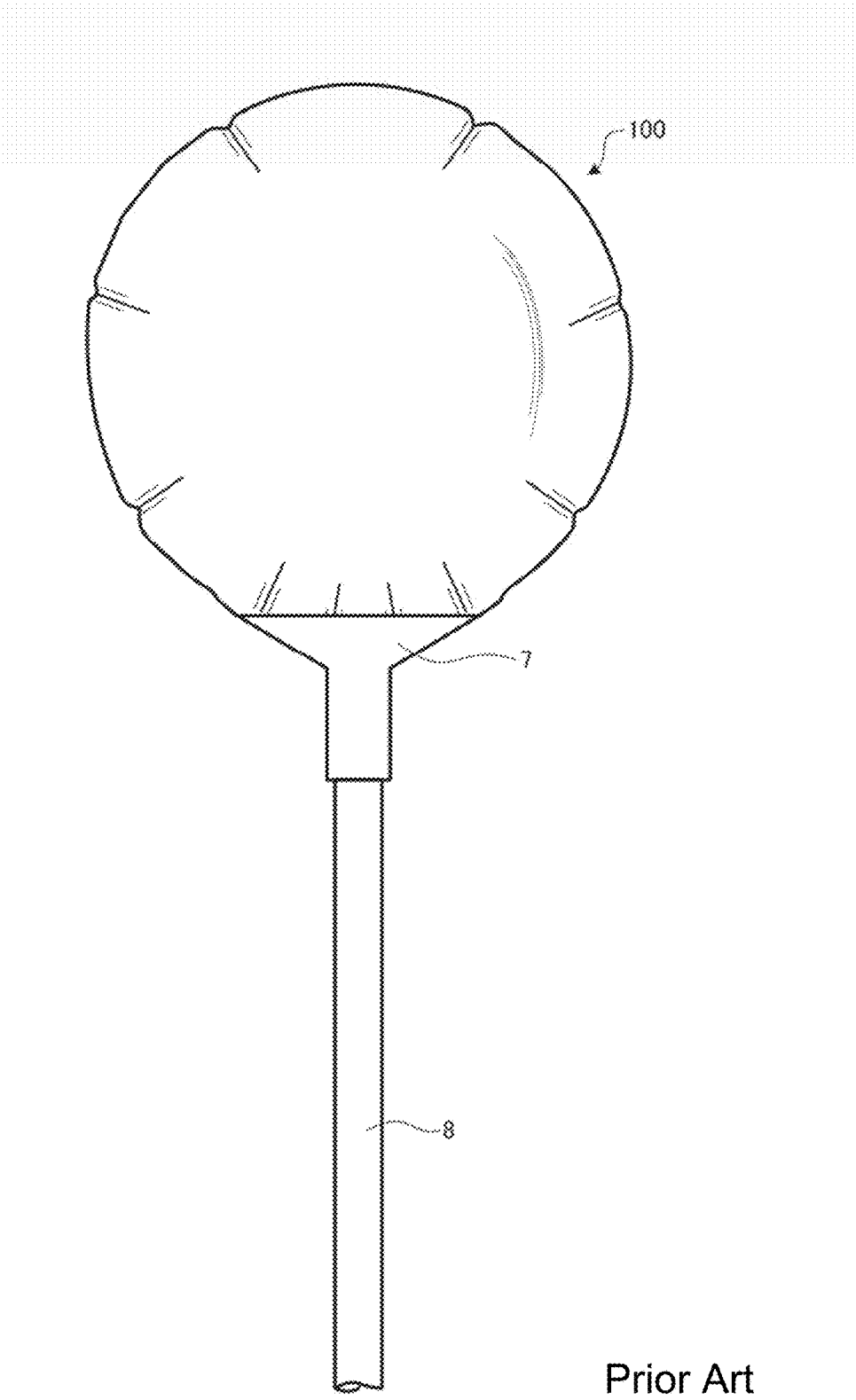
Prior Art FIG. 6
FIG. 6 is a front view of a balloon of Comparative Example 1 in an expanded state.
Figure 7:
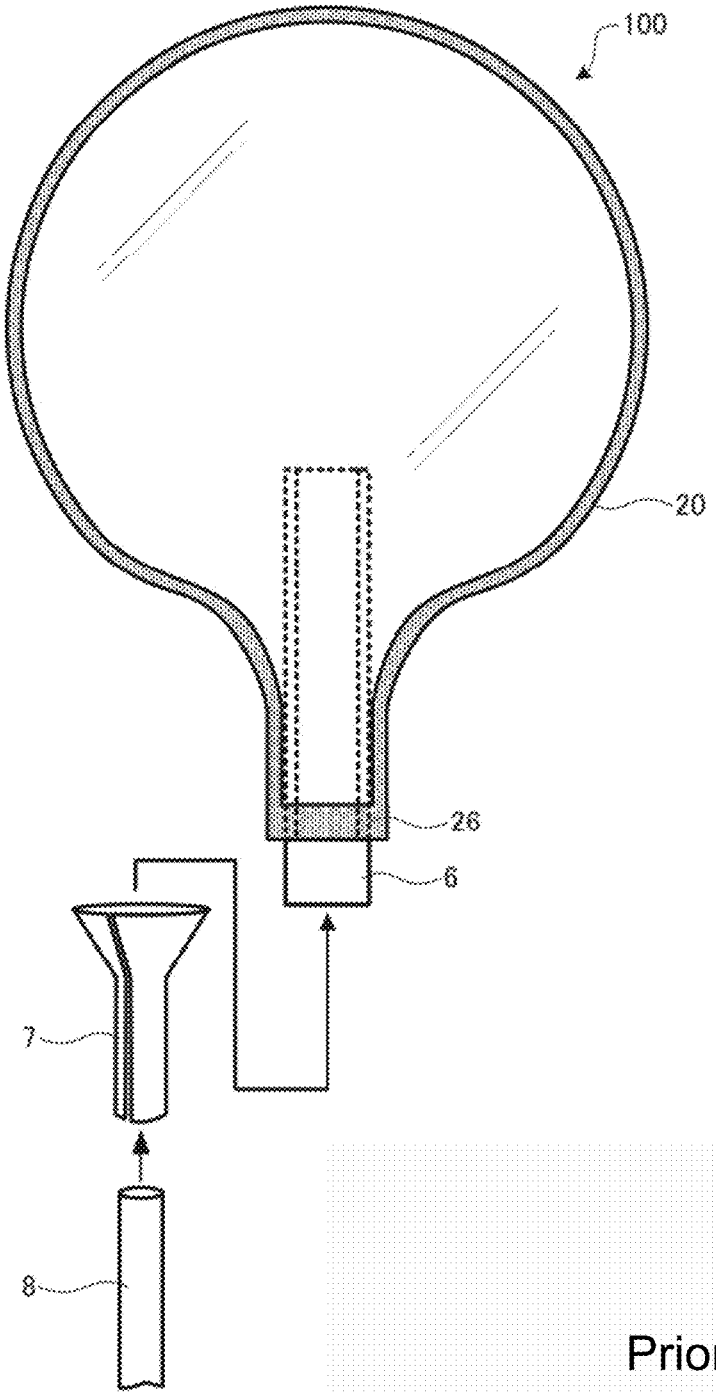
Prior Art FIG. 7
FIG. 7 is a front view of the balloon of Comparative Example 1.

Thus, according to the balloon 1, the balloon 1 can be stably supported by the stick 8 even without the cup 7 (see FIG. 6 and FIG. 7). In addition, according to the balloon 1, it is not necessary to use the cup 7, and hence the operation step of mounting the cup 7 on the balloon 1 can be omitted, with the result that convenience of a user can be enhanced, and there is also economical advantage by virtue of the absence of the cup 7.

1.2. Gas Supply Valve

The gas supply valve 6 is described with reference to FIG. 4.

As illustrated in FIG. 4, the gas supply valve 6 is a sheet obtained by overlapping two soft plastic films on one another and joining both sides of the gas passage 61 extending in the longitudinal direction in edge weld portions 64. The films are easily brought into close contact with each other, and the gas passage 61 is sealed in a normal state without application of a pressure.

The gas supply valve 6 includes narrowed weld portions 66 formed on an inner side of the edge weld portions 64. The narrowed weld portions 66 are obtained by joining the opposed films together through welding in the same manner as in the edge weld portions 64. The narrowed weld portions 66 are formed so that the width of the gas passage 61 is reduced toward the distal end 68 (distal end arranged in the first chamber 14) of the gas supply valve 6.

As illustrated in FIG. 4, when the stick 8 having a pipe body shape is inserted through the gas inlet 62 opened in one end portion of the gas passage 61, the stick 8 can be inserted into the gas passage 61. The gas passage 61 is narrowed with the narrowed weld portions 66, and hence the stick 8 does not reach the distal end 68. A predetermined interval is inevitably formed between the distal end of the stick 8 and the distal end 68 of the gas supply valve 6, and the portion in the predetermined interval functions as a check valve. That is, when gas is blown through the stick 8, the gas passage 61 is opened, and the gas can be sent to the distal end 68 side (into the first chamber 14 in the balloon 1). When the blowing of the gas is stopped, the films of the gas passage 61 into which the stick 8 is not inserted are brought into close contact with each other to close the gas passage 61, thereby functioning as a check valve.

A general gas supply valve not including the narrowed weld portions 66 may be used instead of the gas supply valve 6 illustrated in FIG. 4. In this case, when the stick 8 is inserted into the gas passage, it is necessary to stop the insertion at an appropriate position at which the valve function of the gas supply valve is not inhibited.

2. Manufacturing Method for Balloon

Next, a manufacturing method for the balloon 1 is described with reference to FIG. 1 and FIG. 5.

As illustrated in FIG. 5, the gas supply valve 6 is mounted on the second film 12 being a plastic film, and the first film 10 being another plastic film is overlapped with the second film 12 having the gas supply valve 6 mounted thereon. Then, a predetermined region, for example, a peripheral edge weld portion 20 and the joint portion 26 illustrated in FIG. 1 are welded. Further, the first weld portion 22 and the second weld portion 24 of FIG. 1 are welded. Shaded portions of FIG. 1 correspond to welded regions.

In the peripheral edge weld portion 20, the first weld portion 22, and the second weld portion 24, opposed surfaces of the first film 10 and the second film 12 are joined together through welding. In the joint portion 26, the first film 10 and the gas supply valve 6 are joined together through welding on the front surface side of FIG. 1, and the second film 12 and the gas supply valve 6 are joined together through welding on the back surface side of FIG. 1. An inner surface of the gas supply valve 6 forming the gas passage 61 is not welded.

As materials for the first and second films 10 and 12, known materials made of a synthetic resin, which are used in balloons, for example, polyethylene, polypropylene, polyester, polyamide, and vinyl chloride can be appropriately adopted. Further, the first and second films 10 and 12 may be formed of a metal subjected to vapor deposition, for example, aluminum, a resin excellent in gas barrier property, for example, an ethylene vinyl alcohol copolymer, or a multilayer in which a plurality of sheets are laminated.

As a method for welding, known methods can be used, and thermal welding, high-frequency welding, ultrasonic welding, heat fusion, or the like can be adopted. In a welded portion, the two films 10 and 12 are integrated, and air tightness of the balloon 1 can be ensured.

As described above, the two films, that is, the first and second films 10 and 12 are bonded to each other through welding, and the balloon 1 as illustrated in FIG. 1 can be manufactured.

3. Comparative Example

Figure 8:
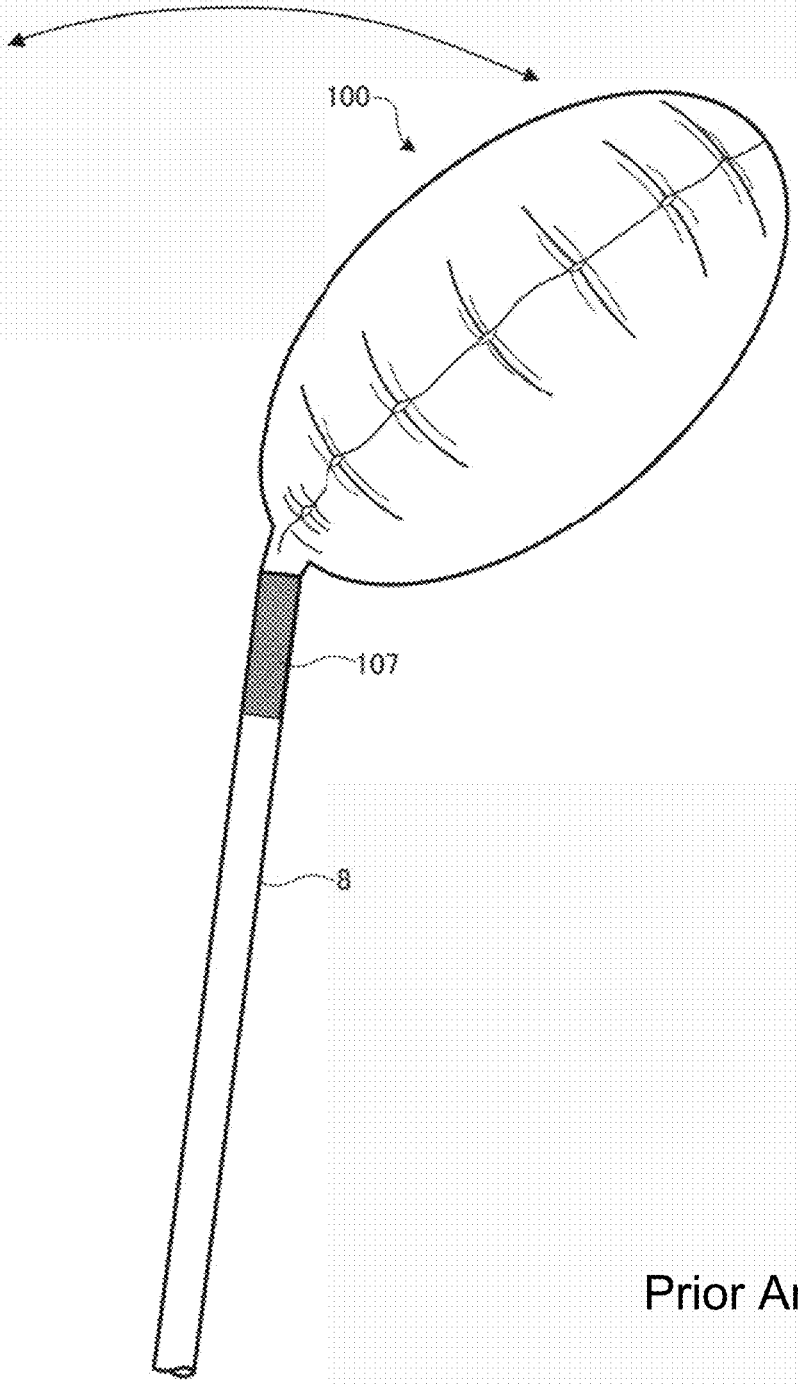
Prior Art FIG. 8
FIG. 8 is a side view of the balloon of Comparative Example 1 in the expanded state.

Next, a related-art balloon 100 is described as a comparative example with reference to FIG. 6 to FIG. 8.

As illustrated in FIG. 6, the balloon 100 is fixed to the cup 7 in an expanded state, and the cup 7 is fixed to the stick 8. The balloon 100 is stably supported by the stick 8 through intermediation of the cup 7.

The balloon 100 is the same as the balloon 1 of FIG. 1 in terms of being formed by welding the two plastic films at a peripheral edge. As illustrated in FIG. 7, the balloon 100 includes a circular main body and a rectangular portion extending from a lower end of the main body, and the gas supply valve 6 is arranged in the rectangular portion. The gas supply valve 6 and the balloon 100 are joined together in the joint portion 26, and the other portions of the gas supply valve 6 are positioned away from the peripheral edge weld portion 20.

As illustrated in FIG. 8, when the rectangular portion of the balloon 100 is fixed to the stick 8 with a pressure-sensitive adhesive tape 107 without using the cup 7, an expanded portion of the balloon 100 is bent in a horizontal direction of FIG. 8 with respect to the stick 8, with the result that a stable state cannot be maintained.

The embodiment described above is merely an example, and the invention is not limited thereto.

The invention includes configurations substantially the same as the configurations described in the embodiment (for example, a configuration having the same function, method, and results, or a configuration having the same object and effects). The invention also includes a configuration in which an unsubstantial element of the configuration described in the embodiment is replaced by another element. The present invention also includes a configuration having the same functions and effects as those of the configuration described in the embodiment, or a configuration capable of achieving the same object as that of the configuration described in the embodiment. The invention further includes a configuration in which a known technique is added to the configuration described in the embodiment.

The entire disclosure of Japanese Patent Application No. 2015-179806, filed on Sep. 11, 2015, is expressly incorporated by reference herein.

The invention claimed is:

1. A balloon comprising:

a first film;

a second film joined to the first film so as to section the balloon into first and second chambers, a balloon inlet being located at an end of the second chamber so that the first chamber is spaced apart from the balloon inlet by the second chamber; and a gas supply valve sandwiched between the first film and the second film in a front view and joined to the first film and the second film at the balloon inlet, the gas supply valve being configured to supply a gas to an inside of the balloon, the gas supply valve being configured by a gas passage having a gas inlet at one end and a gas outlet at the other end, the gas inlet being located at an outer side of the balloon inlet, the gas outlet being located at an inside of the first chamber, the gas passage passing through the second chamber, wherein the first chamber fluidly communicates with the second chamber via a communication port, the gas passage passes through the communication port, part of the first film and part of the second film are joined together at a border between the first chamber and the second chamber to configure a first joined portion, a second joined portion, and the communication port, the second chamber has a shape that diverges from the balloon inlet toward the first chamber, the gas supplied from the gas inlet is firstly introduced into the inside of the first chamber via the gas outlet, the gas supplied in the inside of the first chamber is secondly introduced into an inside of the second chamber via the communication port, and when the balloon is filled with the gas, the gas in the first and second chambers is fluidly isolated from an exterior of the balloon.

2. The balloon according to claim 1, wherein the gas passage is configured to receive a stick the passes through the second chamber so that a distal end of the stick is located inside the first chamber.

3. The balloon according to claim 2, wherein a periphery of the first film and a periphery of the second film are joined together through thermal welding.

4. The balloon according to claim 3, wherein the stick is a tubular stick that is inserted into the gas supply valve, and the gas passes through the tubular stick so as to be introduced into the balloon.

5. The balloon according to claim 4, wherein the tubular stick extends to the inside of the first chamber.

6. The balloon according to claim 2, wherein the stick is a tubular stick that is inserted into the gas supply valve, and the gas passes through the tubular stick so as to be introduced into the balloon.

7. The balloon according to claim 6, wherein the tubular stick extends to the inside of the first chamber.

8. The balloon according to claim 1, wherein a periphery of the first film and a periphery of the second film are joined together through thermal welding.

9. The balloon according to claim 8, further comprising: a tubular stick inserted into the gas supply valve.

10. The balloon according to claim 9, wherein the tubular stick extends to the inside of the first chamber.

11. The balloon according to claim 1, further comprising: a tubular stick inserted into the gas supply valve.

12. The balloon according to claim 11, wherein the tubular stick extends to the inside of the first chamber.

* * * * *